US007821367B2

(12) United States Patent
Fullerton et al.

(10) Patent No.: US 7,821,367 B2
(45) Date of Patent: Oct. 26, 2010

(54) CORRELATED MAGNETIC HARNESS AND METHOD FOR USING THE CORRELATED MAGNETIC HARNESS

(75) Inventors: Larry W. Fullerton, New Hope, AL (US); Mark D. Roberts, Hunstville, AL (US)

(73) Assignee: Cedar Ridge Research, LLC., New Hope, AL (US)

( * ) Notice: Subject to any disclaimer, the term of this patent is extended or adjusted under 35 U.S.C. 154(b) by 0 days.

(21) Appl. No.: 12/478,889

(22) Filed: Jun. 5, 2009

(65) Prior Publication Data

US 2009/0289089 A1 Nov. 26, 2009

Related U.S. Application Data

(63) Continuation-in-part of application No. 12/476,952, filed on Jun. 2, 2009.

(51) Int. Cl.
*H01F 7/20* (2006.01)
*H01F 7/02* (2006.01)
*A41D 1/04* (2006.01)

(52) U.S. Cl. ..... 335/306; 335/285; 2/102

(58) Field of Classification Search ..... 335/285, 335/302–306; 24/303; 2/102–103, 312, 2/315, 319, 321, 322, 338, 422, 462, 913
See application file for complete search history.

(56) References Cited

U.S. PATENT DOCUMENTS

| | | | |
|---|---|---|---|
| 381,968 | A | 5/1888 | Tesla |
| 493,858 | A | 3/1893 | Edison |
| 996,933 | A | 7/1911 | Lindquist |
| 1,236,234 | A | 8/1917 | Troje |
| 2,389,298 | A | 11/1945 | Ellis |
| 2,570,625 | A | 10/1951 | Zimmerman et al. |
| 2,722,617 | A | 11/1955 | Cluwen et al. |
| 2,932,545 | A | 4/1960 | Foley |
| 3,102,314 | A | 9/1963 | Alderfer |
| 3,208,296 | A | 9/1965 | Baermann |

(Continued)

FOREIGN PATENT DOCUMENTS

| | | |
|---|---|---|
| FR | 823395 | 1/1938 |

(Continued)

OTHER PUBLICATIONS

"BNS Series-Compatible Series AES Safety Controllers"pp. 1-17, http://www.schmersalusa.com/safety_controllers/drawings/aes.pdf (downloaded on or before Jan. 23, 2009).

(Continued)

*Primary Examiner*—Ramon M Barrera
(74) *Attorney, Agent, or Firm*—William J. Tucker

(57) ABSTRACT

A harness is described herein that uses correlated magnets to enable objects to be secured thereto and removed therefrom. Some examples of such a harness include a construction work harness, a soldier harness, an astronaut harness, and a scuba harness (e.g., buoyancy compensator). For instance, the scuba harness can have different types of objects secured thereto and removed therefrom such as a weight pouch, a utility pocket, a dive light (flash light), a camera, a scuba lanyard, a navigation board, a depth gauge, a spear gun, or any type of military equipment.

25 Claims, 13 Drawing Sheets

U.S. PATENT DOCUMENTS

| | | | |
|---|---|---|---|
| 3,288,511 | A | 11/1966 | Tavano |
| 3,468,576 | A | 9/1969 | Beyer et al. |
| 3,474,366 | A | 10/1969 | Barney |
| 3,802,034 | A | 4/1974 | Bookless |
| 4,079,558 | A | 3/1978 | Gorham |
| 4,222,489 | A | 9/1980 | Hutter |
| 4,453,294 | A | 6/1984 | Morita |
| 4,547,756 | A | 10/1985 | Miller et al. |
| 4,629,131 | A | 12/1986 | Podell |
| 4,941,236 | A | 7/1990 | Sherman |
| 5,050,276 | A | 9/1991 | Pemberton |
| 5,367,891 | A | 11/1994 | Furuyama |
| 5,383,049 | A | 1/1995 | Carr |
| 5,631,093 | A | 5/1997 | Perry et al. |
| 5,631,618 | A | 5/1997 | Trumper et al. |
| 6,072,251 | A | 6/2000 | Markle |
| 6,170,131 | B1 | 1/2001 | Shin |
| 6,275,778 | B1 | 8/2001 | Shimada et al. |
| 6,457,179 | B1 | 10/2002 | Prendergast |
| 6,607,304 | B1 | 8/2003 | Lake et al. |
| 6,720,698 | B2 | 4/2004 | Galbraith |
| 6,847,134 | B2 | 1/2005 | Frissen et al. |
| 6,862,748 | B2 | 3/2005 | Prendergast |
| 6,927,657 | B1 | 8/2005 | Wu |
| 6,971,147 | B2 | 12/2005 | Haltstead |
| 7,066,778 | B2 | 6/2006 | Kretzschmar |
| 7,362,018 | B1 | 4/2008 | Kulogo et al. |
| 7,444,683 | B2 | 11/2008 | Prendergast et al. |
| 2004/0003487 | A1 | 1/2004 | Reiter |
| 2006/0066428 | A1 | 3/2006 | McCarthy et al. |
| 2006/0189259 | A1 | 8/2006 | Park |
| 2006/0290451 | A1 | 12/2006 | Prendergast et al. |
| 2008/0043458 | A1 * | 2/2008 | Desjardin ..... 362/108 |
| 2008/0186683 | A1 | 8/2008 | Ligtenberg et al. |
| 2008/0272868 | A1 | 11/2008 | Prendergast et al. |
| 2008/0282517 | A1 | 11/2008 | Claro |

FOREIGN PATENT DOCUMENTS

| | | | |
|---|---|---|---|
| WO | 2007081830 | A2 | 7/2007 |

OTHER PUBLICATIONS

"Magnetic Safety Sensors"pp. 1-3, http://farnell.com/datasheets/6465.pdf (downloaded on or before Jan. 23, 2009).

"Series BNS-B20 Coded-Magnet Sensor Safety Door Handle" pp. 1-2, http://www.schmersalusa.com/catalog_pdfs/BNS_ B20.pdf (downloaded on or before Jan. 23, 2009).

"Series BNS333 Coded-Magnet Sensors with Integrated Safety Control Module" pp. 1-2, http://www.schmersalusa.com/machine_guarding/coded_magnet/drawings/bns333.pdf (downloaded on or before Jan. 23, 2009).

* cited by examiner

FIG. 3B
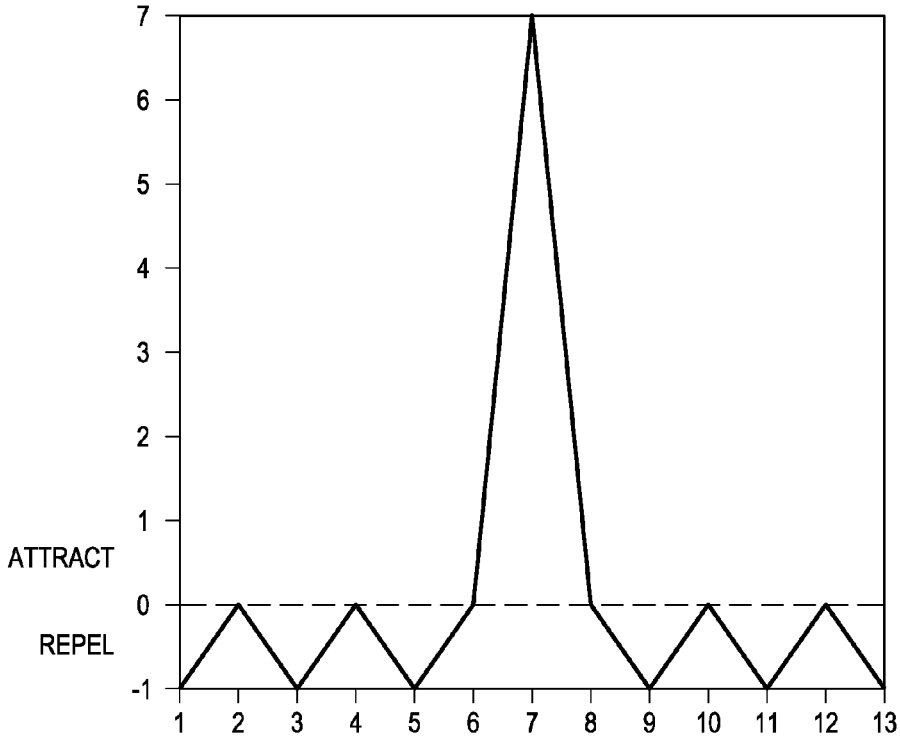
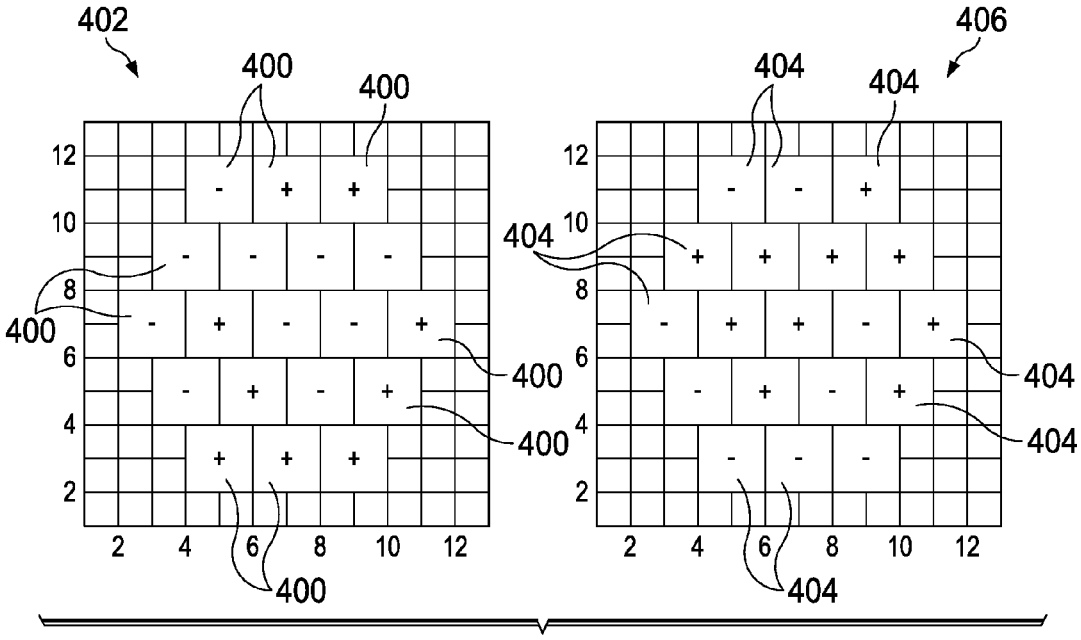
FIG. 4A

CORRELATED MAGNETIC HARNESS AND METHOD FOR USING THE CORRELATED MAGNETIC HARNESS

CROSS REFERENCE TO RELATED APPLICATIONS

This application is a continuation-in-part application of U.S. patent application Ser. No. 12/476,952 filed on Jun. 2, 2009 and entitled "A Field Emission System and Method", which is a continuation-in-part application of U.S. patent application Ser. No. 12/322,561 filed on Feb. 4, 2009 and entitled "A System and Method for Producing an Electric Pulse", which is a continuation-in-part application of U.S. patent application Ser. No. 12/358,423 filed on Jan. 23, 2009 and entitled "A Field Emission System and Method", which is a continuation-in-part application of U.S. patent application Ser. No. 12/123,718 filed on May 20, 2008 and entitled "A Field Emission System and Method". The contents of these four documents are hereby incorporated herein by reference.

TECHNICAL FIELD

The present invention is related to a harness that incorporates correlated magnets which enable objects to be secured to and removed from the harness. Some examples of such a harness include a construction work harness, a soldier harness, an astronaut harness, and a scuba harness (e.g., buoyancy compensator). The present invention is demonstrated using scuba equipment including, for example, a scuba harnesses (e.g., buoyancy compensator).

DESCRIPTION OF RELATED ART

In an underwater environment, for example, it would be desirable to provide a person with a scuba harness (e.g., buoyancy compensator) that makes it easy for them to secure objects thereto and remove objects therefrom regardless if they are above water or underwater. Unfortunately, the traditional scuba harness (e.g., buoyancy compensator) employs loops, buckles, clamps, hooks, or other known fastening mechanisms which require a great degree of dexterity on the part of the person to use when they secure objects thereto and remove objects therefrom. Accordingly, there has been a need for a new type of scuba harness (e.g., buoyancy compensator) which addresses the aforementioned shortcoming and other shortcomings associated with the traditional scuba harness. In addition, there is a need for a new type of harness that can be used in other environments like construction, military and space. These needs and other needs are satisfied by the present invention.

SUMMARY

In one aspect, the present invention provides a harness adapted to have an object secured thereto and the object removed thereform. The harness has a vest including a first field emission structure which interacts with a second field emission structure associated with the object. The object is attached to the vest when the first and second field emission structures are located next to one another and have a certain alignment with respect to one another. The object is released from the vest when the first field emission structure and the second field emission structure are turned with respect to one another. Each of the first and second field emission structures include a plurality of field emission sources having positions and polarities relating to a desired spatial force function that corresponds to a relative alignment of the first and second field emission structures within a field domain. This is possible because each of the field emission sources has a corresponding field emission amplitude and vector direction determined in accordance with the desired spatial force function, wherein a separation distance between the first and second field emission structures and the relative alignment of the first and second field emission structures creates a spatial force in accordance the desired spatial force function. The field domain corresponds to first field emissions from the first field emission sources of the first field emission structure interacting with second field emissions from the second field emission sources of the second field emission structure.

In another aspect, the present invention provides a method enabling an object to be attached to and removed from a vest. The method including the steps of: (a) attaching a first field emission structure to the vest; (b) attaching a second field emission structure to the object; and (c) aligning the first and second field emission structures so the object attaches to the vest when the first and second field emission structures are located next to one another, where each of the first and second field emission structures include a plurality of field emission sources having positions and polarities relating to a desired spatial force function that corresponds to a relative alignment of the first and second field emission structures within a field domain. The object can be released from the vest when the first and second field emission structures are turned with respect to one another.

Additional aspects of the invention will be set forth, in part, in the detailed description, figures and any claims which follow, and in part will be derived from the detailed description, or can be learned by practice of the invention. It is to be understood that both the foregoing general description and the following detailed description are exemplary and explanatory only and are not restrictive of the invention as disclosed.

BRIEF DESCRIPTION OF THE DRAWINGS

A more complete understanding of the present invention may be obtained by reference to the following detailed description when taken in conjunction with the accompanying drawings wherein.

DETAILED DESCRIPTION

The present invention includes a harness which utilizes correlated magnetic technology to enable a wide variety of objects (e.g., tools, flashlights, cameras) to be easily connected thereto and removed therefrom. The harness which utilizes correlated magnetic technology is a significant improvement over a conventional harness which employs loops, buckles, clamps, hooks, or other known fastening devices to enable the connection and removal of objects (e.g., tools, flashlights, cameras). This significant improvement over the state-of-art is attributable, in part, to the use of an emerging, revolutionary technology that is called correlated magnetics.

This new revolutionary technology called correlated magnetics was first fully described and enabled in the co-assigned U.S. patent application Ser. No. 12/123,718 filed on May 20, 2008 and entitled "A Field Emission System and Method". The contents of this document are hereby incorporated herein by reference. A second generation of a correlated magnetic technology is described and enabled in the co-assigned U.S. patent application Ser. No. 12/358,423 filed on Jan. 23, 2009 and entitled "A Field Emission System and Method". The contents of this document are hereby incorporated herein by reference. A third generation of a correlated magnetic technology is described and enabled in the co-assigned U.S. patent application Ser. No. 12/476,952 filed on Jun. 2, 2009 and entitled "A Field Emission System and Method". The contents of this document are hereby incorporated herein by reference. Another technology known as correlated inductance, which is related to correlated magnetics, has been described and enabled in the co-assigned U.S. patent application Ser. No. 12/322,561 filed on Feb. 4, 2009 and entitled "A System and Method for Producing and Electric Pulse". The contents of this document are hereby incorporated herein by reference. A brief discussion about correlated magnetics is provided first before a detailed discussion is provided about the correlated magnetic harness of the present invention.

Correlated Magnetics Technology

This section is provided to introduce the reader to basic magnets and the new and revolutionary correlated magnetic technology. This section includes subsections relating to basic magnets, correlated magnets, and correlated electromagnetics. It should be understood that this section is provided to assist the reader with understanding the present invention, and should not be used to limit the scope of the present invention.

A. Magnets

Figure 1:
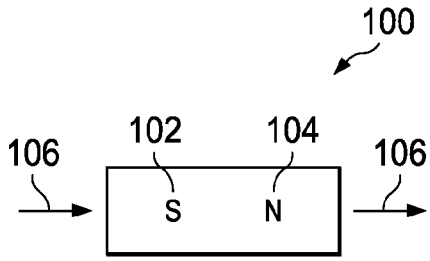
FIGS. 1-9 are various diagrams used to help explain different concepts about correlated magnetic technology which can be utilized in an embodiment of the present invention.

A magnet is a material or object that produces a magnetic field which is a vector field that has a direction and a magnitude (also called strength). Referring to FIG. 1, there is illustrated an exemplary magnet 100 which has a South pole 102 and a North pole 104 and magnetic field vectors 106 that represent the direction and magnitude of the magnet's moment. The magnet's moment is a vector that characterizes the overall magnetic properties of the magnet 100. For a bar magnet, the direction of the magnetic moment points from the South pole 102 to the North pole 104. The North and South poles 104 and 102 are also referred to herein as positive (+) and negative (−) poles, respectively.

Figure 2A:
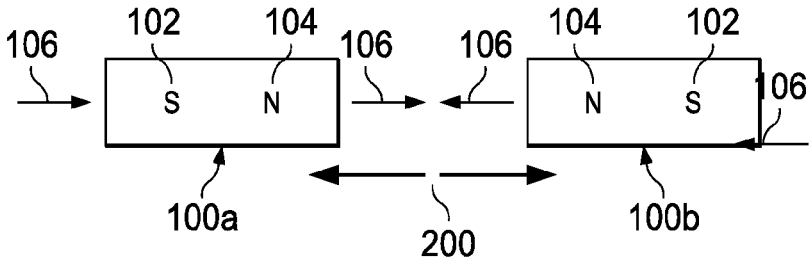
Figure 2B:
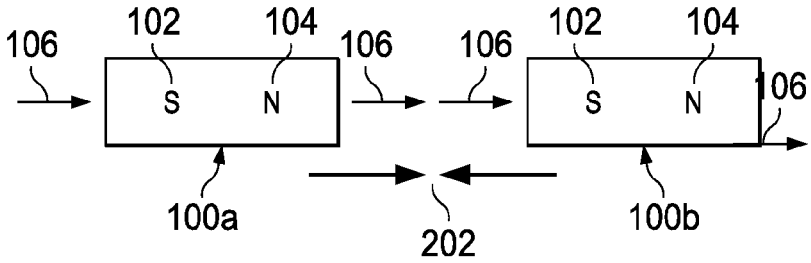
Figure 2C:
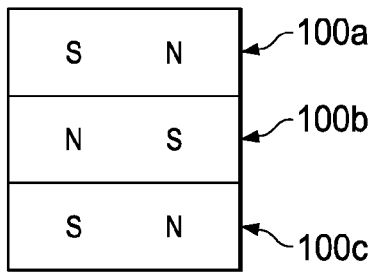

Referring to FIG. 2A, there is a diagram that depicts two magnets 100*a* and 100*b* aligned such that their polarities are opposite in direction resulting in a repelling spatial force 200 which causes the two magnets 100*a* and 100*b* to repel each other. In contrast, FIG. 2B is a diagram that depicts two magnets 100*a* and 100*b* aligned such that their polarities are in the same direction resulting in an attracting spatial force 202 which causes the two magnets 100*a* and 100*b* to attract each other. In FIG. 2B, the magnets 100*a* and 100*b* are shown as being aligned with one another but they can also be partially aligned with one another where they could still "stick" to each other and maintain their positions relative to each other. FIG. 2C is a diagram that illustrates how magnets 100*a*, 100*b* and 100*c* will naturally stack on one another such that their poles alternate.

B. Correlated Magnets

Correlated magnets can be created in a wide variety of ways depending on the particular application as described in the aforementioned U.S. patent application Ser. Nos. 12/123,718, 12/358,432, and 12/476,952 by using a unique combination of magnet arrays (referred to herein as magnetic field emission sources), correlation theory (commonly associated with probability theory and statistics) and coding theory (commonly associated with communication systems). A brief discussion is provided next to explain how these widely diverse technologies are used in a unique and novel way to create correlated magnets.

Basically, correlated magnets are made from a combination of magnetic (or electric) field emission sources which have been configured in accordance with a pre-selected code having desirable correlation properties. Thus, when a magnetic field emission structure is brought into alignment with a complementary, or mirror image, magnetic field emission structure the various magnetic field emission sources will all align causing a peak spatial attraction force to be produced, while the misalignment of the magnetic field emission structures cause the various magnetic field emission sources to substantially cancel each other out in a manner that is a function of the particular code used to design the two magnetic field emission structures. In contrast, when a magnetic field emission structure is brought into alignment with a duplicate magnetic field emission structure then the various magnetic field emission sources all align causing a peak spatial repelling force to be produced, while the misalignment of the magnetic field emission structures causes the various magnetic field emission sources to substantially cancel each other out in a manner that is a function of the particular code used to design the two magnetic field emission structures.

The aforementioned spatial forces (attraction, repelling) have a magnitude that is a function of the relative alignment of two magnetic field emission structures and their corresponding spatial force (or correlation) function, the spacing (or distance) between the two magnetic field emission structures, and the magnetic field strengths and polarities of the various sources making up the two magnetic field emission structures. The spatial force functions can be used to achieve precision alignment and precision positioning not possible with basic magnets. Moreover, the spatial force functions can enable the precise control of magnetic fields and associated spatial forces thereby enabling new forms of attachment devices for attaching objects with precise alignment and new systems and methods for controlling precision movement of objects. An additional unique characteristic associated with correlated magnets relates to the situation where the various magnetic field sources making-up two magnetic field emission structures can effectively cancel out each other when they are brought out of alignment which is described herein as a release force. This release force is a direct result of the particular correlation coding used to configure the magnetic field emission structures.

A person skilled in the art of coding theory will recognize that there are many different types of codes that have different correlation properties which have been used in communications for channelization purposes, energy spreading, modulation, and other purposes. Many of the basic characteristics of such codes make them applicable for use in producing the magnetic field emission structures described herein. For example, Barker codes are known for their autocorrelation properties and can be used to help configure correlated magnets. Although, a Barker code is used in an example below with respect to FIGS. 3A-3B, other forms of codes which may or may not be well known in the art are also applicable to correlated magnets because of their autocorrelation, cross-correlation, or other properties including, for example, Gold codes, Kasami sequences, hyperbolic congruential codes, quadratic congruential codes, linear congruential codes, Welch-Costas array codes, Golomb-Costas array codes, pseudorandom codes, chaotic codes, Optimal Golomb Ruler codes, deterministic codes, designed codes, one dimensional codes, two dimensional codes, three dimensional codes, or four dimensional codes, combinations thereof, and so forth.

Figure 3A:
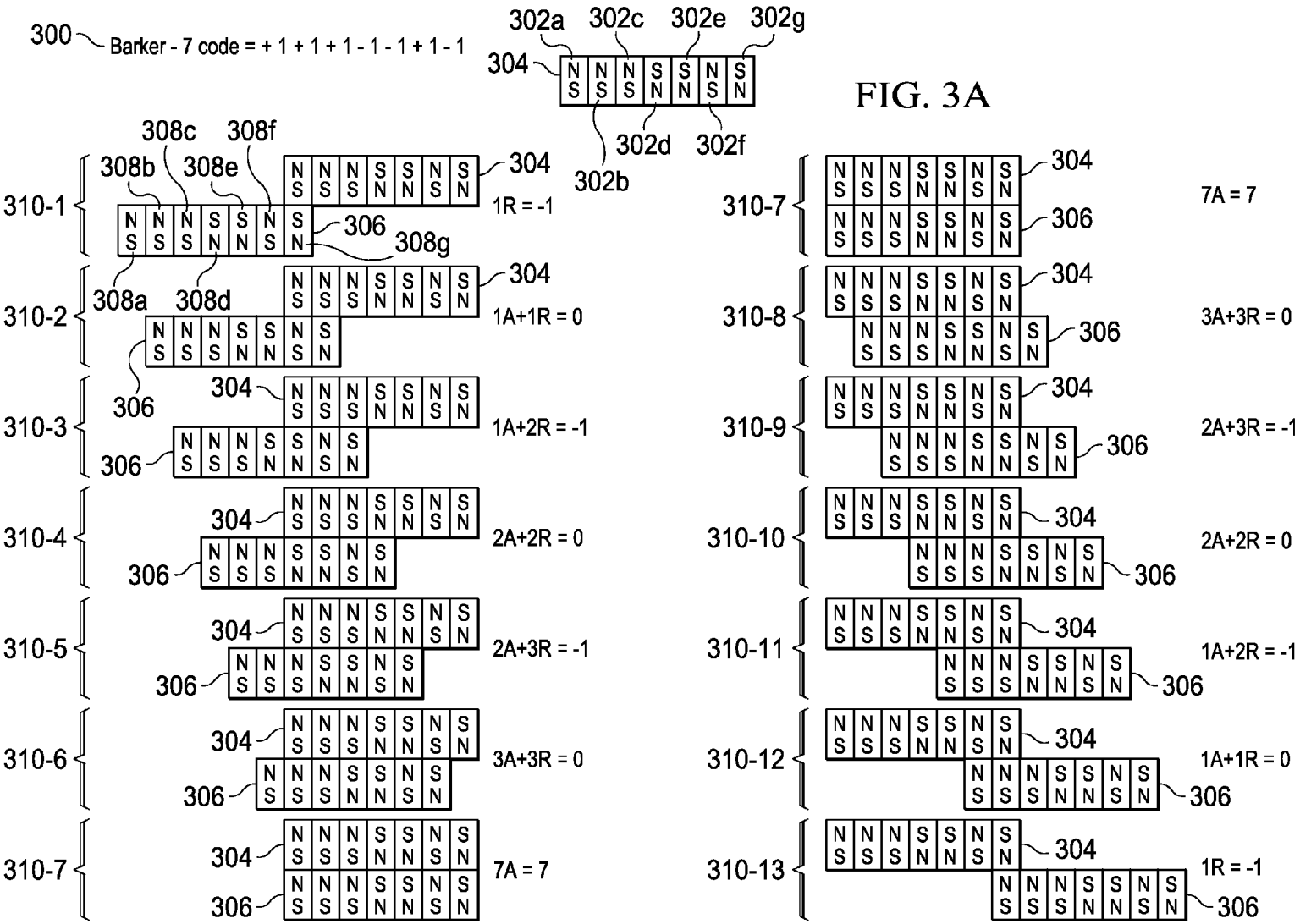

Referring to FIG. 3A, there are diagrams used to explain how a Barker length 7 code 300 can be used to determine polarities and positions of magnets 302*a*, 302*b* . . . 302*g* making up a first magnetic field emission structure 304. Each magnet 302*a*, 302*b* . . . 302*g* has the same or substantially the same magnetic field strength (or amplitude), which for the sake of this example is provided as a unit of 1 (where A=Attract, R=Repel, A=−R, A=1, R=−1). A second magnetic field emission structure 306 (including magnets 308*a*, 308*b* . . . 308*g*) that is identical to the first magnetic field emission structure 304 is shown in 13 different alignments 310-1 through 310-13 relative to the first magnetic field emission structure 304. For each relative alignment, the number of magnets that repel plus the number of magnets that attract is calculated, where each alignment has a spatial force in accordance with a spatial force function based upon the correlation function and magnetic field strengths of the magnets 302*a*, 302*b* . . . 302*g* and 308*a*, 308*b* . . . 308*g*. With the specific Barker code used, the spatial force varies from −1 to 7, where the peak occurs when the two magnetic field emission structures 304 and 306 are aligned which occurs when their respective codes are aligned. The off peak spatial force, referred to as a side lobe force, varies from 0 to −1. As such, the spatial force function causes the magnetic field emission structures 304 and 306 to generally repel each other unless they are aligned such that each of their magnets are correlated with a complementary magnet (i.e., a magnet's South pole aligns with another magnet's North pole, or vice versa). In other words, the two magnetic field emission structures 304 and 306 substantially correlate with one another when they are aligned to substantially mirror each other.

In FIG. 3B, there is a plot that depicts the spatial force function of the two magnetic field emission structures 304 and 306 which results from the binary autocorrelation function of the Barker length 7 code 300, where the values at each alignment position 1 through 13 correspond to the spatial force values that were calculated for the thirteen alignment positions 310-1 through 310-13 between the two magnetic field emission structures 304 and 306 depicted in FIG. 3A. As the true autocorrelation function for correlated magnet field structures is repulsive, and most of the uses envisioned will have attractive correlation peaks, the usage of the term 'autocorrelation' herein will refer to complementary correlation unless otherwise stated. That is, the interacting faces of two such correlated magnetic field emission structures 304 and 306 will be complementary to (i.e., mirror images of) each other. This complementary autocorrelation relationship can be seen in FIG. 3A where the bottom face of the first magnetic field emission structure 304 having the pattern 'S S S N N S N' is shown interacting with the top face of the second magnetic field emission structure 306 having the pattern 'N N N S S N S', which is the mirror image (pattern) of the bottom face of the first magnetic field emission structure 304.

Figure 4B:
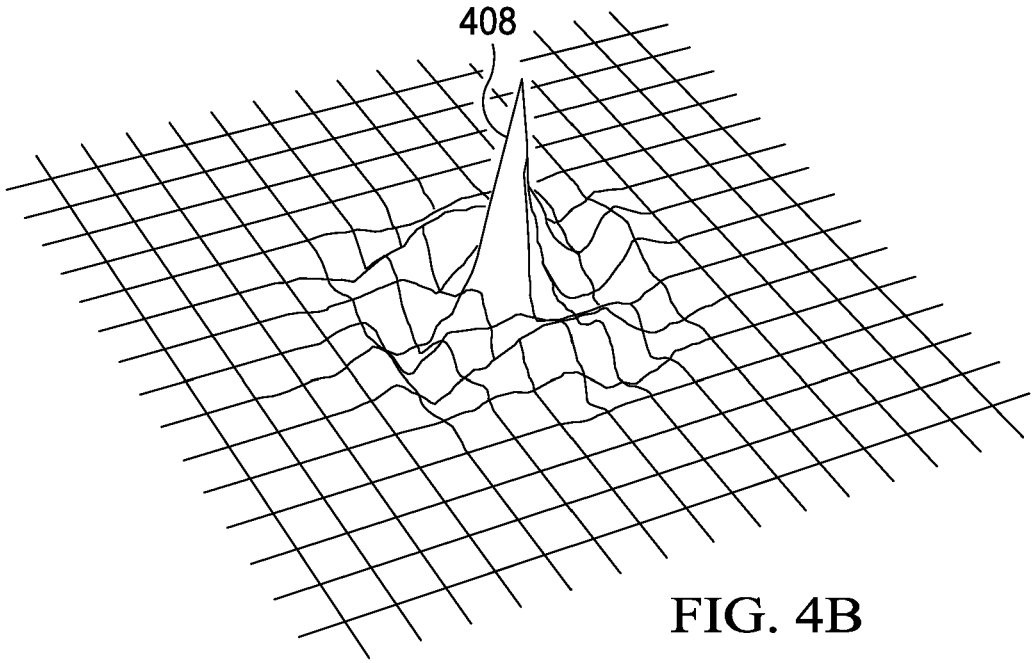
Figure 4C:
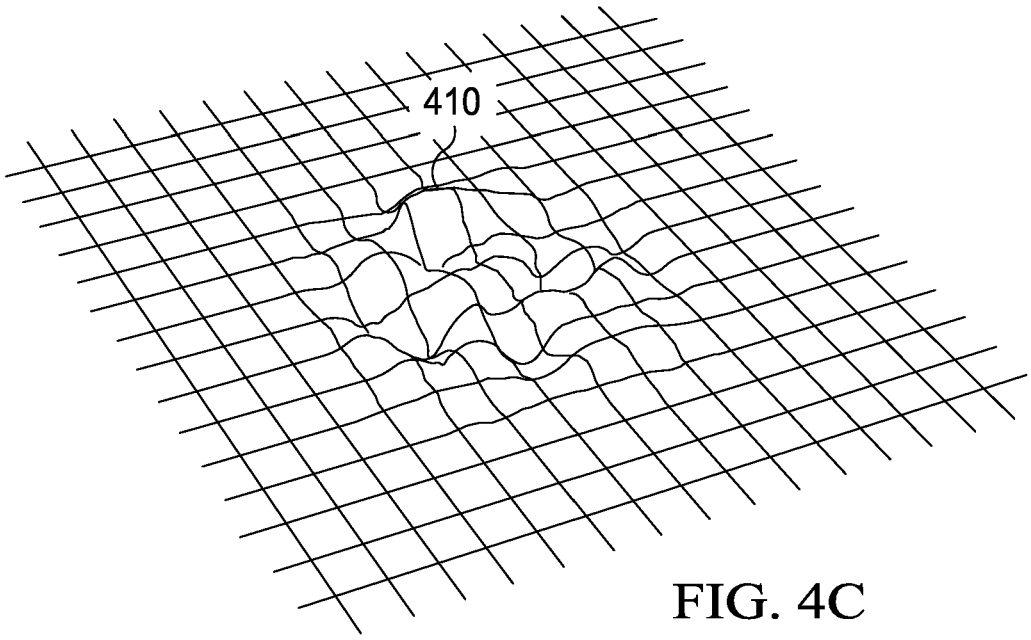

Referring to FIG. 4A, there is a diagram of an array of 19 magnets 400 positioned in accordance with an exemplary code to produce an exemplary magnetic field emission structure 402 and another array of 19 magnets 404 which is used to produce a mirror image magnetic field emission structure 406. In this example, the exemplary code was intended to produce the first magnetic field emission structure 402 to have a first stronger lock when aligned with its mirror image magnetic field emission structure 406 and a second weaker lock when it is rotated 90° relative to its mirror image magnetic field emission structure 406. FIG. 4B depicts a spatial force function 408 of the magnetic field emission structure 402 interacting with its mirror image magnetic field emission structure 406 to produce the first stronger lock. As can be seen, the spatial force function 408 has a peak which occurs when the two magnetic field emission structures 402 and 406 are substantially aligned. FIG. 4C depicts a spatial force function 410 of the magnetic field emission structure 402 interacting with its mirror magnetic field emission structure 406 after being rotated 90°. As can be seen, the spatial force function 410 has a smaller peak which occurs when the two magnetic field emission structures 402 and 406 are substantially aligned but one structure is rotated 90°. If the two magnetic field emission structures 402 and 406 are in other positions then they could be easily separated.

Figure 5:
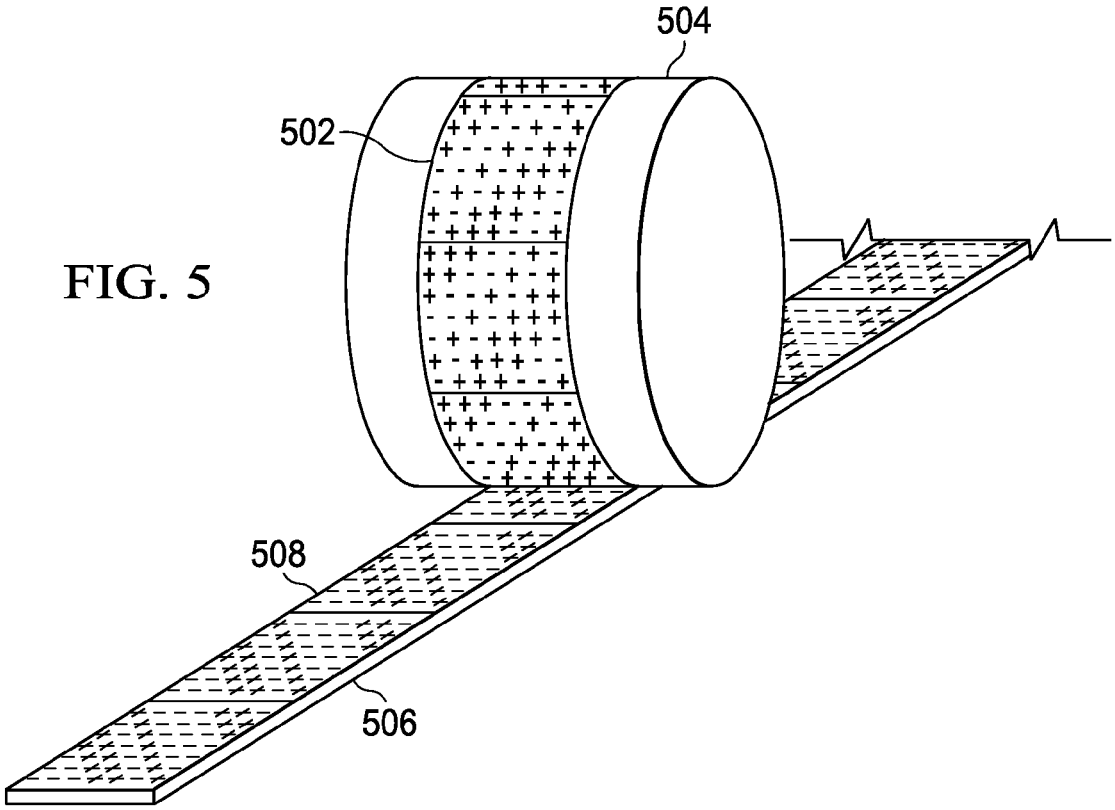

Referring to FIG. 5, there is a diagram depicting a correlating magnet surface 502 being wrapped back on itself on a cylinder 504 (or disc 504, wheel 504) and a conveyor belt/tracked structure 506 having located thereon a mirror image correlating magnet surface 508. In this case, the cylinder 504 can be turned clockwise or counter-clockwise by some force so as to roll along the conveyor belt/tracked structure 506. The fixed magnetic field emission structures 502 and 508 provide a traction and gripping (i.e., holding) force as the cylinder 504 is turned by some other mechanism (e.g., a motor). The gripping force would remain substantially constant as the cylinder 504 moved down the conveyor belt/tracked structure 506 independent of friction or gravity and could therefore be used to move an object about a track that moved up a wall, across a ceiling, or in any other desired direction within the limits of the gravitational force (as a function of the weight of the object) overcoming the spatial force of the aligning magnetic field emission structures 502 and 508. If desired, this cylinder 504 (or other rotary devices) can also be operated against other rotary correlating surfaces to provide a gear-like operation. Since the hold-down force equals the traction force, these gears can be loosely connected and still give positive, non-slipping rotational accuracy. Plus, the magnetic field emission structures 502 and 508 can have surfaces which are perfectly smooth and still provide positive, non-slip traction. In contrast to legacy friction-based wheels, the traction force provided by the magnetic field emission structures 502 and 508 is largely independent of the friction forces between the traction wheel and the traction surface and can be employed with low friction surfaces. Devices moving about based on magnetic traction can be operated independently of gravity for example in weightless conditions including space, underwater, vertical surfaces and even upside down.

Figure 6:
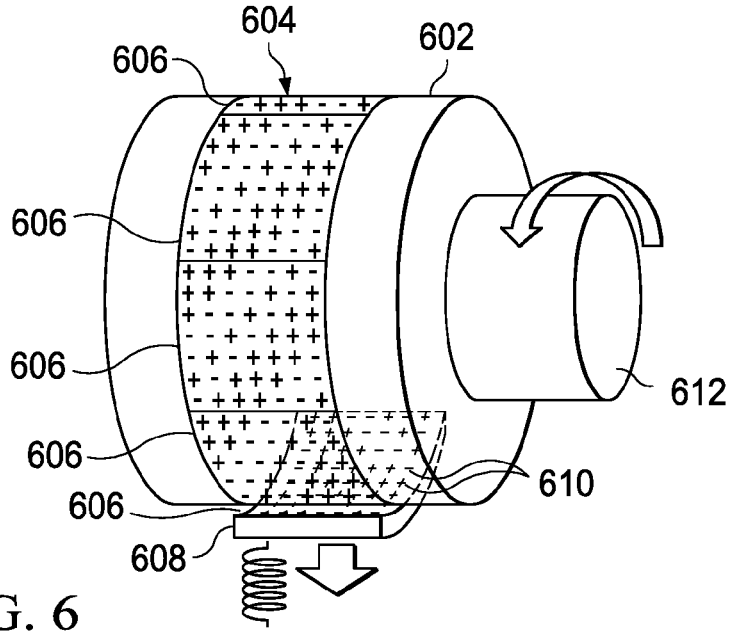

Referring to FIG. 6, there is a diagram depicting an exemplary cylinder 602 having wrapped thereon a first magnetic field emission structure 604 with a code pattern 606 that is repeated six times around the outside of the cylinder 602. Beneath the cylinder 602 is an object 608 having a curved surface with a slightly larger curvature than the cylinder 602 and having a second magnetic field emission structure 610 that is also coded using the code pattern 606. Assume, the cylinder 602 is turned at a rotational rate of 1 rotation per second by shaft 612. Thus, as the cylinder 602 turns, six times a second the first magnetic field emission structure 604 on the cylinder 602 aligns with the second magnetic field emission structure 610 on the object 608 causing the object 608 to be repelled (i.e., moved downward) by the peak spatial force function of the two magnetic field emission structures 604 and 610. Similarly, had the second magnetic field emission structure 610 been coded using a code pattern that mirrored code pattern 606, then 6 times a second the first magnetic field emission structure 604 of the cylinder 602 would align with the second magnetic field emission structure 610 of the object 608 causing the object 608 to be attracted (i.e., moved upward) by the peak spatial force function of the two magnetic field emission structures 604 and 610. Thus, the movement of the cylinder 602 and the corresponding first magnetic field emission structure 604 can be used to control the movement of the object 608 having its corresponding second magnetic field emission structure 610. One skilled in the art will recognize that the cylinder 602 may be connected to a shaft 612 which may be turned as a result of wind turning a windmill, a water wheel or turbine, ocean wave movement, and other methods whereby movement of the object 608 can result from some source of energy scavenging. As such, correlated magnets enables the spatial forces between objects to be precisely controlled in accordance with their movement and also enables the movement of objects to be precisely controlled in accordance with such spatial forces.

In the above examples, the correlated magnets 304, 306, 402, 406, 502, 508, 604 and 610 overcome the normal 'magnet orientation' behavior with the aid of a holding mechanism such as an adhesive, a screw, a bolt & nut, etc. . . . In other cases, magnets of the same magnetic field emission structure could be sparsely separated from other magnets (e.g., in a sparse array) such that the magnetic forces of the individual magnets do not substantially interact, in which case the polarity of individual magnets can be varied in accordance with a code without requiring a holding mechanism to prevent magnetic forces from 'flipping' a magnet. However, magnets are typically close enough to one another such that their magnetic forces would substantially interact to cause at least one of them to 'flip' so that their moment vectors align but these magnets can be made to remain in a desired orientation by use of a holding mechanism such as an adhesive, a screw, a bolt & nut, etc. . . . As such, correlated magnets often utilize some sort of holding mechanism to form different magnetic field emission structures which can be used in a wide-variety of applications like, for example, a turning mechanism, a tool insertion slot, alignment marks, a latch mechanism, a pivot mechanism, a swivel mechanism, a lever, a drill head assembly, a hole cutting tool assembly, a machine press tool, a gripping apparatus, a slip ring mechanism, and a structural assembly.

C. Correlated Electromagnetics

Correlated magnets can entail the use of electromagnets which is a type of magnet in which the magnetic field is produced by the flow of an electric current. The polarity of the magnetic field is determined by the direction of the electric current and the magnetic field disappears when the current ceases. Following are a couple of examples in which arrays of electromagnets are used to produce a first magnetic field emission structure that is moved over time relative to a second magnetic field emission structure which is associated with an object thereby causing the object to move.

Figure 7:
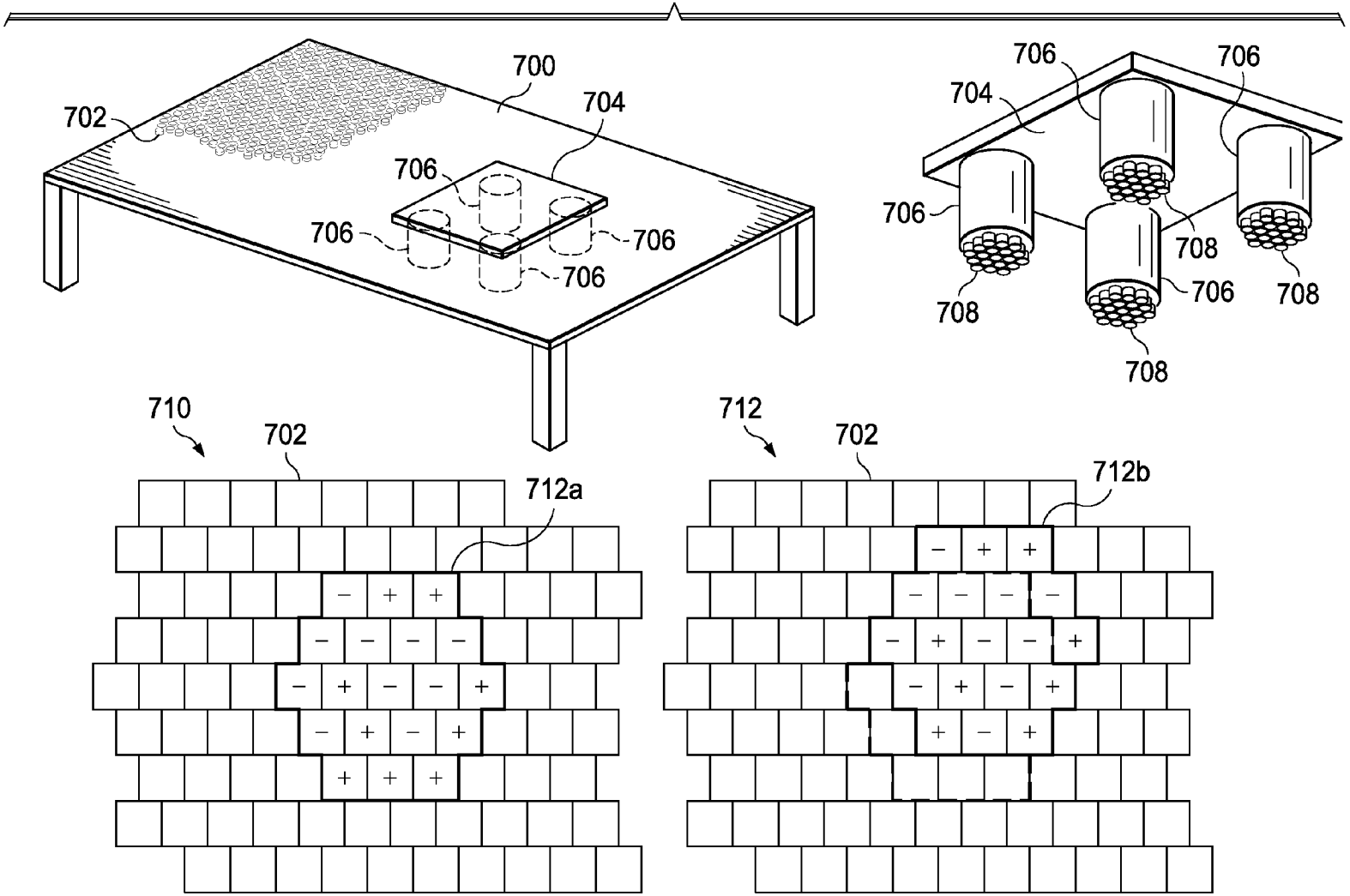

Referring to FIG. 7, there are several diagrams used to explain a 2-D correlated electromagnetics example in which there is a table 700 having a two-dimensional electromagnetic array 702 (first magnetic field emission structure 702) beneath its surface and a movement platform 704 having at least one table contact member 706. In this example, the movement platform 704 is shown having four table contact members 706 each having a magnetic field emission structure 708 (second magnetic field emission structures 708) that would be attracted by the electromagnetic array 702. Computerized control of the states of individual electromagnets of the electromagnet array 702 determines whether they are on or off and determines their polarity. A first example 710 depicts states of the electromagnetic array 702 configured to cause one of the table contact members 706 to attract to a subset 712*a* of the electromagnets within the magnetic field emission structure 702. A second example 712 depicts different states of the electromagnetic array 702 configured to cause the one table contact member 706 to be attracted (i.e., move) to a different subset 712*b* of the electromagnets within the field emission structure 702. Per the two examples, one skilled in the art can recognize that the table contact member(s) 706 can be moved about table 700 by varying the states of the electromagnets of the electromagnetic array 702.

Figure 8:
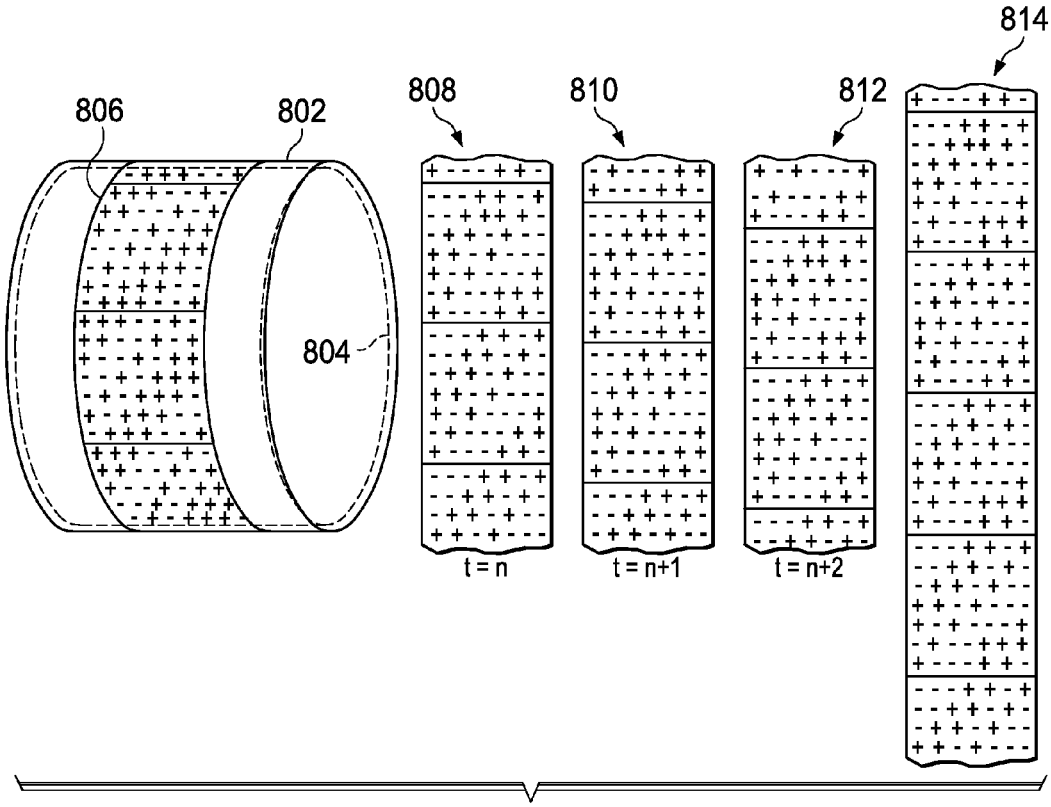

Referring to FIG. 8, there are several diagrams used to explain a 3-D correlated electromagnetics example where there is a first cylinder 802 which is slightly larger than a second cylinder 804 that is contained inside the first cylinder 802. A magnetic field emission structure 806 is placed around the first cylinder 802 (or optionally around the second cylinder 804). An array of electromagnets (not shown) is associated with the second cylinder 804 (or optionally the first cylinder 802) and their states are controlled to create a moving mirror image magnetic field emission structure to which the magnetic field emission structure 806 is attracted so as to cause the first cylinder 802 (or optionally the second cylinder 804) to rotate relative to the second cylinder 804 (or optionally the first cylinder 802). The magnetic field emission structures 808, 810, and 812 produced by the electromagnetic array on the second cylinder 804 at time t=n, t=n+1, and t=n+2, show a pattern mirroring that of the magnetic field emission structure 806 around the first cylinder 802. The pattern is shown moving downward in time so as to cause the first cylinder 802 to rotate counterclockwise. As such, the speed and direction of movement of the first cylinder 802 (or the second cylinder 804) can be controlled via state changes of the electromagnets making up the electromagnetic array. Also depicted in FIG. 8 there is an electromagnetic array 814 that corresponds to a track that can be placed on a surface such that a moving mirror image magnetic field emission structure can be used to move the first cylinder 802 backward or forward on the track using the same code shift approach shown with magnetic field emission structures 808, 810, and 812 (compare to FIG. 5).

Figure 9:
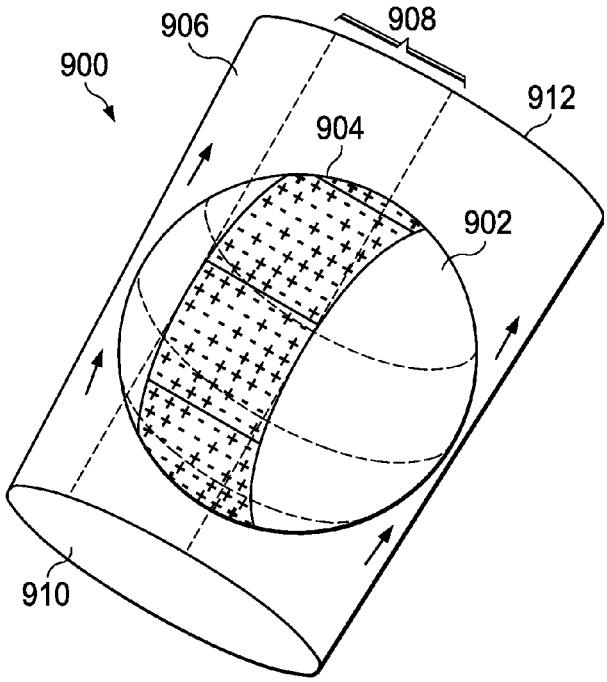

Referring to FIG. 9, there is illustrated an exemplary valve mechanism 900 based upon a sphere 902 (having a magnetic field emission structure 904 wrapped thereon) which is located in a cylinder 906 (having an electromagnetic field emission structure 908 located thereon). In this example, the electromagnetic field emission structure 908 can be varied to move the sphere 902 upward or downward in the cylinder 906 which has a first opening 910 with a circumference less than or equal to that of the sphere 902 and a second opening 912 having a circumference greater than the sphere 902. This configuration is desirable since one can control the movement of the sphere 902 within the cylinder 906 to control the flow rate of a gas or liquid through the valve mechanism 900. Similarly, the valve mechanism 900 can be used as a pressure control valve. Furthermore, the ability to move an object within another object having a decreasing size enables various types of sealing mechanisms that can be used for the sealing of windows, refrigerators, freezers, food storage containers, boat hatches, submarine hatches, etc., where the amount of sealing force can be precisely controlled. One skilled in the art will recognize that many different types of seal mechanisms that include gaskets, o-rings, and the like can be employed with the use of the correlated magnets. Plus, one skilled in the art will recognize that the magnetic field emission structures can have an array of sources including, for example, a permanent magnet, an electromagnet, an electret, a magnetized ferromagnetic material, a portion of a magnetized ferromagnetic material, a soft magnetic material, or a superconductive magnetic material, some combination thereof, and so forth.

Correlated Magnetic Harness

Referring to FIGS. 10-13, there are disclosed an exemplary correlated magnetic harness 1000 and method for using the exemplary correlated magnetic belts-harness 1000 in accordance with an embodiment of the present invention. Although the exemplary harness 1000 is described herein as being configured like a scuba harness (e.g., buoyancy compensator), it should be understood that a similar correlated magnetic harness can be configured for a wide-variety of applications including, for example, a construction work harness, a soldier harness, and an astronaut harness. Accordingly, the correlated magnetic harness 1000 and method for using the correlated magnetic harness 1000 should not be construed in a limited manner.

Figure 10A:
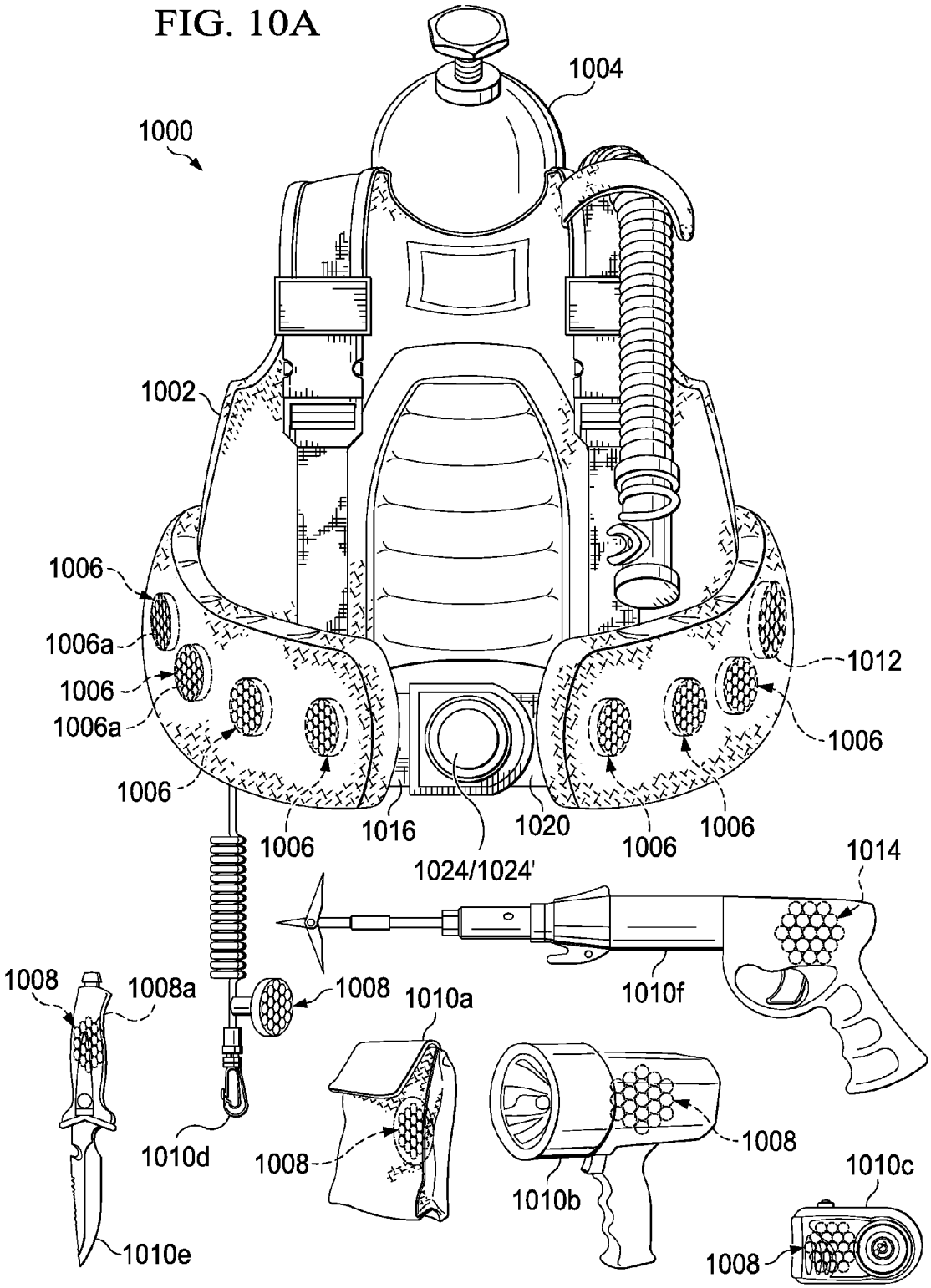
FIGS. 10A and 10B are diagrams of an exemplary correlated magnetic scuba harness (e.g., buoyancy compensator) in accordance with an embodiment of the present invention.
Figure 10B:
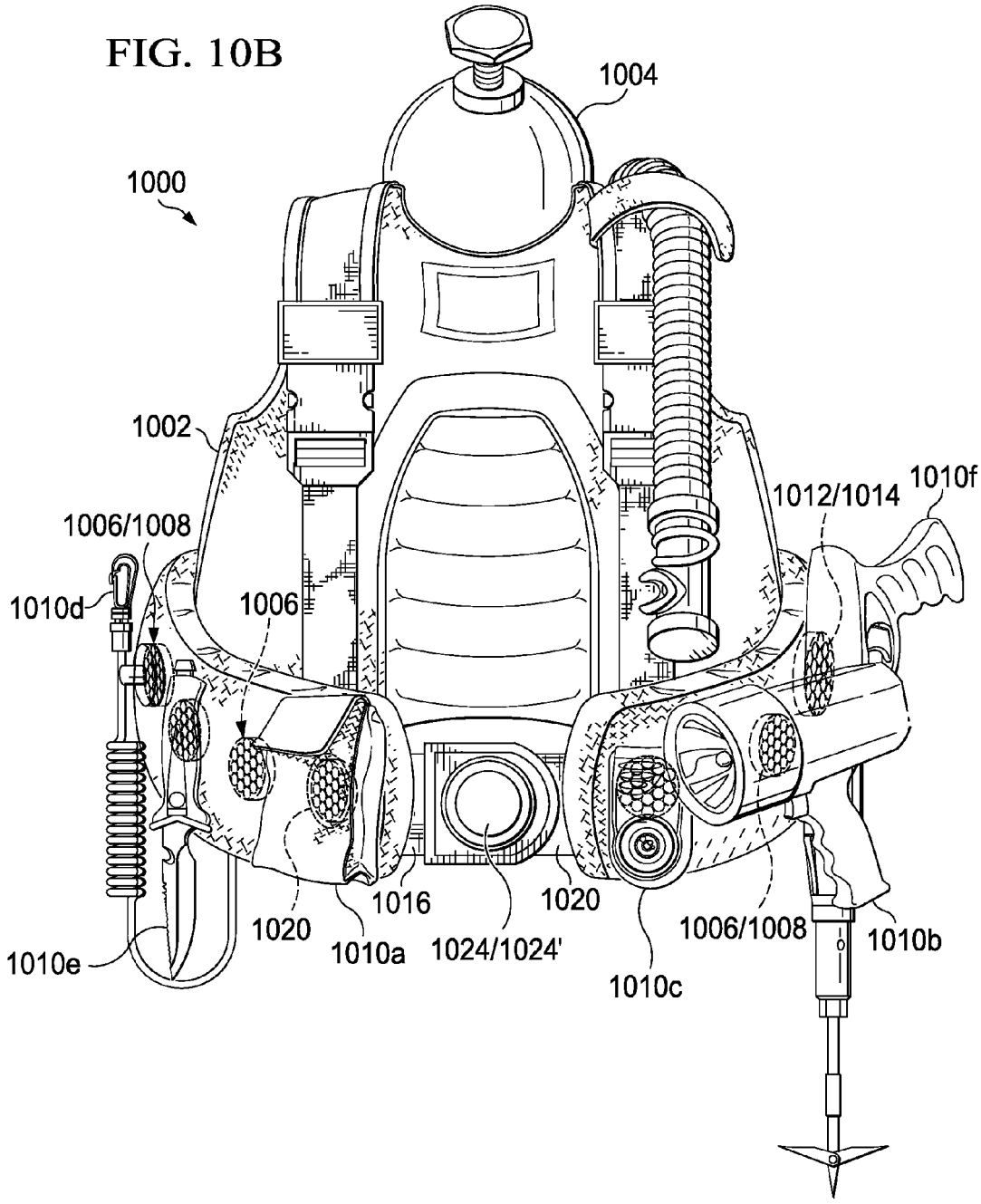

Referring to FIGS. 10A-10B, there are diagrams of the exemplary correlated magnetic scuba harness 1000 (e.g., buoyancy compensator 1000) in accordance with an embodiment of the present invention. The correlated magnetic scuba harness 1000 (e.g., buoyancy compensator 1000) includes a vest 1002 which in this example can support an optional oxygen tank 1004 and also has attached thereto (incorporated therein) one or more first magnetic field emission structures 1006. The first magnetic field emission structures 1006 are configured to interact with one or more second magnetic field emission structures 1008 attached to or incorporated within the one or more objects 1010 such that when desired the objects 1010 can be attached (secured) to or removed from the vest 1010. In the scuba environment, the objects 1010 can be a wide-variety to items such as for example a utility pocket 1010*a* (shown), a dive light 1010*b* (or flash light 1010*b*) (shown), a camera 1010*c* (shown), a scuba lanyard 1010*d* (shown), dive knife 1010*e* (shown), a spear gun 1010*f* (shown), a navigation board, a depth gauge, or any type of military equipment 1010.

Each object 1010*a* . . . 1010*f* can be attached to the vest 1002 when their respective first and second magnetic field emission structures 1006 and 1008 are located next to one another and have a certain alignment with respect to one another (see FIG. 10B). Under one arrangement, the object 1010*a* . . . 1010*f* would be attached to the vest 1002 with a desired strength to prevent the object 100*a* . . . 110*f* from being inadvertently disengaged from the vest 1002. Each object 1010*a* . . . 110*f* can be released from the vest 1002 when their respective first and second magnetic field emission structures 1006 and 1008 are turned with respect to one another (see FIG. 10A).

The process of attaching and detaching the object 1010*a* . . . 1010*f* to and from the vest 1002 is possible because the first and second magnetic field emission structures 1006 and 1008 each include an array of field emission sources 1006*a* and 1008*a* (e.g., an array of magnets 1006*a* and 1008*a*) each having positions and polarities relating to a desired spatial force function that corresponds to a relative alignment of the first and second magnetic field emission structures 1006 and 1008 within a field domain (see discussion about correlated magnet technology). In this example, the first and second magnetic field emissions structures 1006 and 1008 both have the same code but are a mirror image of one another (see FIGS. 4 and 11). However, the first and second field emission structures 1006 and 1008 and other pairs of field emission structures depicted in FIGS. 10A-10B and in other drawings associated with other exemplary correlated magnetic harness 1000 are themselves exemplary. Generally, the field emission structures 1006 and 1008 and other pairs of field emission structures could have many different configurations and could be many different types of permanent magnets, electromagnets, and/or electro-permanent magnets where their size, shape, source strengths, coding, and other characteristics can be tailored to meet different requirements. An example of how an object 1010 can be attached (secured) to or removed from the vest 1002 is discussed in detail below with respect to FIGS. 11A-11I.

Figure 11A:
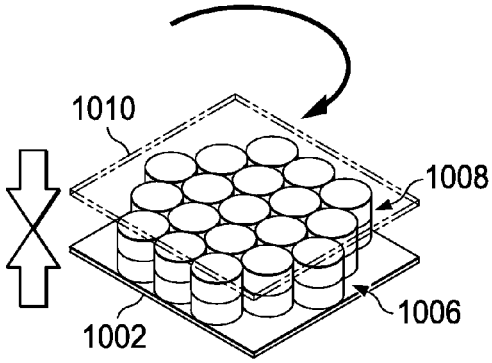
FIGS. 11A-11I are several diagrams that illustrate a portion of the scuba harness which are used to show how an exemplary first magnetic field emission structure (attached to a vest) and its mirror image second magnetic field emission structure (attached to an object) can be aligned or misaligned relative to each other to enable one to secure or remove the object from the vest in accordance with an embodiment of the present invention.
Figure 11D:
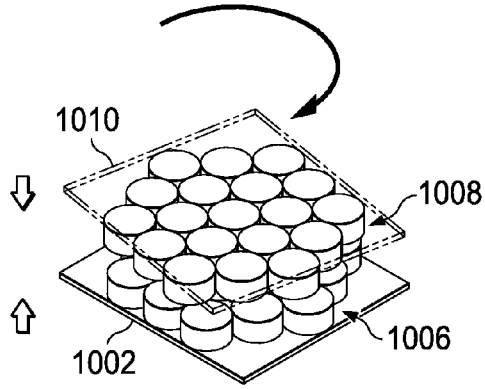
Figure 11B:
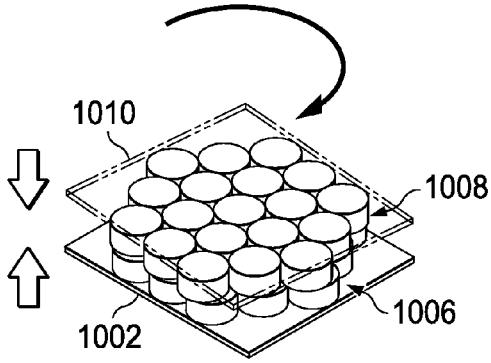
Figure 11E:
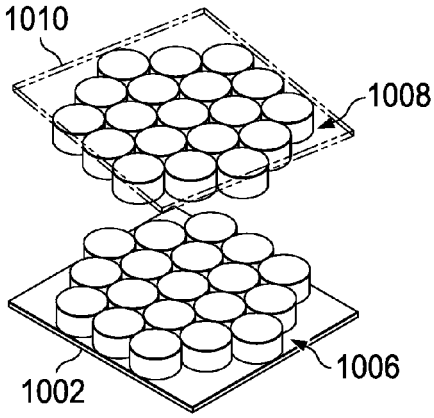
Figure 11C:
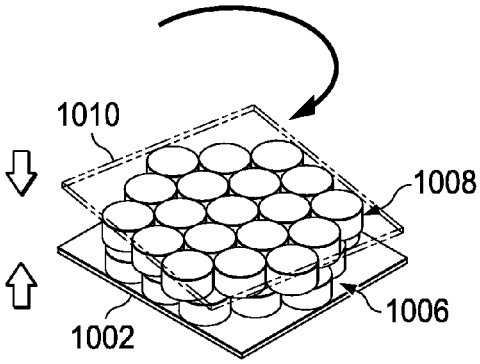
Figure 11F:
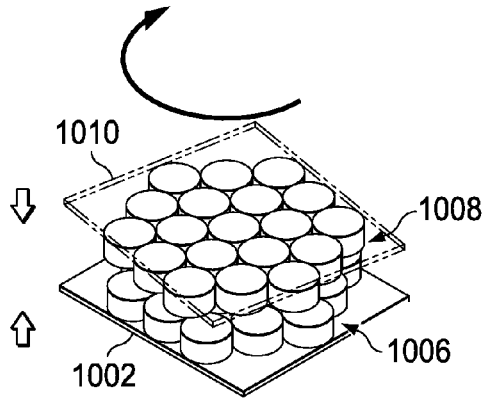
Figure 11G:
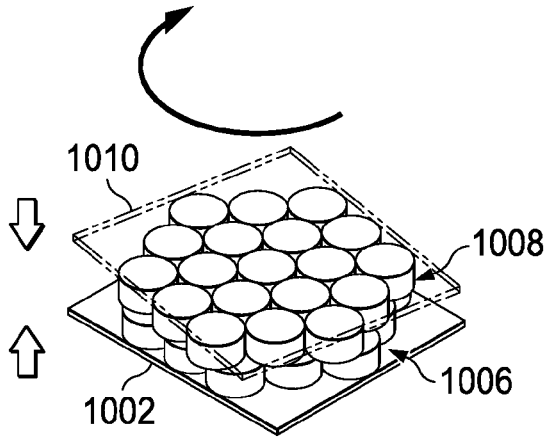
Figure 11H:
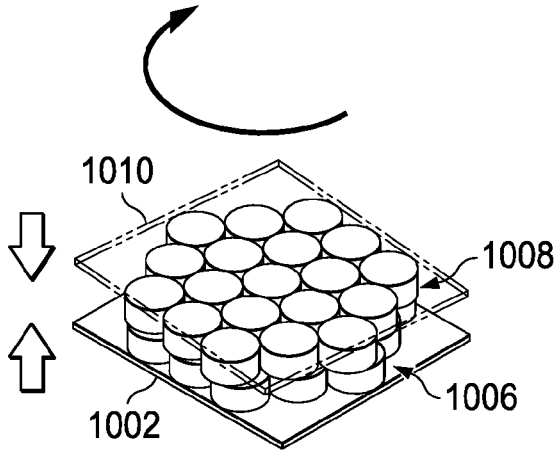
Figure 11I:
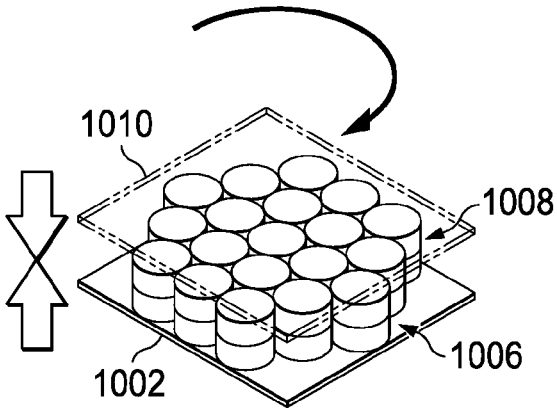

Referring to FIGS. 11A-11I, there is depicted an exemplary first magnetic field emission structure 1006 (attached to the vest 1002) and its mirror image second magnetic field emission structure 1008 (attached to object 1010) and the resulting spatial forces produced in accordance with their various alignments as they are twisted relative to each other which enables one to secure or remove the object 1010 from the vest 1002. In FIG. 11A, the first magnetic field emission structure 1006 and the mirror image second magnetic field emission structure 1008 are aligned producing a peak spatial force. In FIG. 11B, the mirror image second magnetic field emission structure 1008 is rotated clockwise slightly relative to the first magnetic field emission structure 1006 and the attractive force reduces significantly. In FIG. 11C, the mirror image second magnetic field emission structure 1008 is further rotated and the attractive force continues to decrease. In FIG. 11D, the mirror image second magnetic field emission structure 1008 is still further rotated until the attractive force becomes very small, such that the two magnetic field emission structures 1006 and 1008 are easily separated as shown in FIG. 11E. One skilled in the art would also recognize that the object 1010 can also be detached from the vest 1002 by applying a pull force, shear force, or any other force sufficient to overcome the attractive peak spatial force between the substantially aligned first and second field emission structures 1006 and 1008. Given the two magnetic field emission structures 1006 and 1008 held somewhat apart as in FIG. 11E, the two magnetic field emission structures 1006 and 1008 can be moved closer and rotated towards alignment producing a small spatial force as in FIG. 11F. The spatial force increases as the two magnetic field emission structures 1006 and 1008 become more and more aligned in FIGS. 11G and 11H and a peak spatial force is achieved when aligned as in FIG. 11I. It should be noted that the direction of rotation was arbitrarily chosen and may be varied depending on the code employed. Additionally, the second magnetic field emission structure

1008 is the mirror image of the first magnetic field emission structure 1006 resulting in an attractive peak spatial force (see also FIGS. 3-4). This way of securing and removing an object 1010 to and from the vest 1002 is a marked-improvement over the prior art in which the conventional vest had loops, buckles, clamps, hooks, or other known fastening mechanisms which required a great degree of dexterity on the part of the person to use when they wanted to secure and remove objects 1010. This dexterity is even more difficult to come-by when the person is an underwater situation.

In operation, the user could pick-up one of the objects 1010*a* . . . 1010*f* of which incorporates the second magnetic field emission structure 1008. The user would move the object 1010 towards the vest 1002 which incorporates the first magnetic field emission structure 1006. Then, the user would align the first and second magnetic field emission structures 1006 and 1008 such that the object 1010 can be attached to the vest 1002 when the first and second magnetic field emission structures 1006 and 1008 are located next to one another and have a certain alignment with respect to one another where they correlate with each other to produce a peak attractive force. The user can release the object 1010 from the vest 1002 by turning the second magnetic field emission structure 1008 relative to the first magnetic field emission structure 1006 so as to misalign the two field emission structures 1006 and 1008. This process for attaching and detaching the object 1010 to and from the vest 1002 is possible because each of the first and second magnetic field emission structures 1006 and 1008 includes an array of field emission sources 1006*a* and 1008*a* each having positions and polarities relating to a desired spatial force function that corresponds to a relative alignment of the first and second magnetic field emission structures 1006 and 1008 within a field domain. Each field emission source of each array of field emission sources 1006*a* and 1008*a* has a corresponding field emission amplitude and vector direction determined in accordance with the desired spatial force function, where a separation distance between the first and second magnetic field emission structures 1006 and 1008 and the relative alignment of the first and second magnetic field emission structures 1006 and 1008 creates a spatial force in accordance with the desired spatial force function. The field domain corresponds to first field emissions from the array of first field emission sources 1006*a* of the first magnetic field emission structure 1006 interacting with second field emissions from the array of second field emission sources 1008*a* of the second magnetic field emission structure 1008.

If desired, the vest 1002 can have attached thereto a third magnetic field emission structure 1012 which is configured to interact with a mirror image fourth magnetic field emission structure 1014 associated with an object 1010. In this case, the third and fourth magnetic field emission structures 1012 and 1014 would be configured and/or decoded differently than the first and second magnetic field emission structures 1006 and 1008 such that fourth magnetic field emission structure 1014 in the object 1010 will not interact with the first magnetic field emission structure 1006 in the vest 1002. This is desirable since it allows only certain objects 1010 to be secured to certain locations on the vest 1002. Plus, certain objects 1010 may be heavier than other objects 1010 which would require a different configuration of the magnetic field emission structures so that they can still be secured to and removed from the vest 1002 (e.g., see spear gun 1010*f* in FIGS. 10A-10B).

Figure 12A:
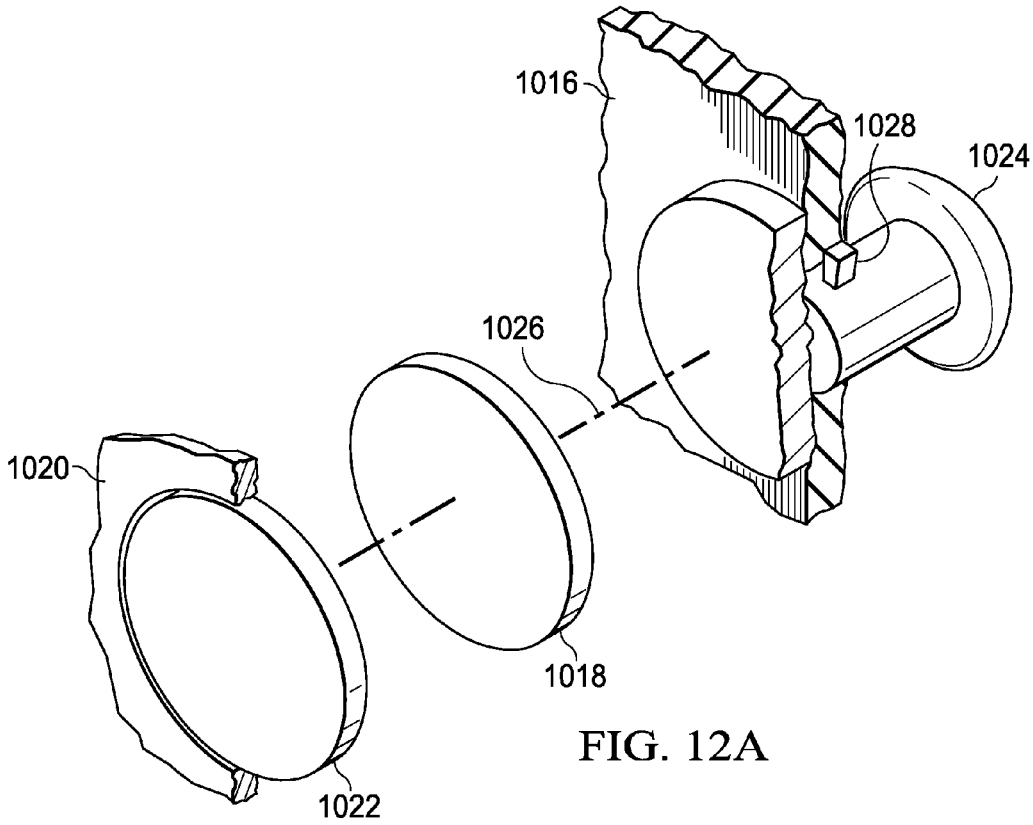
FIGS. 12A-12C illustrate several diagrams of an exemplary release mechanism that can be used to attach or separate two ends of the scuba harness in accordance with an embodiment of the present invention.

In this example, the vest 1002 has one end 1016 which has attached thereto a fifth magnetic field emission structure 1018 and another end 1020 which has attached thereto a sixth mirror image magnetic field emission structure 1022 (see FIG. 12A). This makes it possible for the one end 1016 to be attached to the other end 1020 when the fifth magnetic field emission structure 1018 is located next to the sixth magnetic field emission structure 1022 and they have a certain alignment with respect to one another. As an option, the end 1016 can have multiple fifth magnetic field emission structures 1018 with a certain amount of space located between them so a person can control the tension of the vest 1002 around themselves by selecting one of the fifth magnetic field emission structures 1018 to attach to the sixth magnetic field emission structure 1022. The one end 1016 can be separated or released from the other end 1020 when the fifth magnetic field emission structure 1018 is turned with respect to the mirror image sixth magnetic field emission structure 1022. In one case, a release mechanism 1024 and 1024' (e.g., turn-knob 1024 and 1024') may be secured to the fifth magnetic field emission structure 1018 and be used to turn the fifth magnetic field emission structure 1018 relative to the sixth magnetic field emission structure 1022 so as to separate the two ends 1016 and 1020. Two exemplary release mechanisms 1024 and 1024' are described in greater detail below with respect to FIGS. 12 and 13.

Figure 12B:
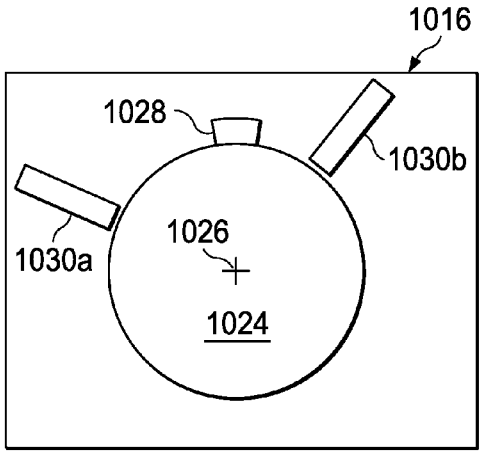
Figure 12C:
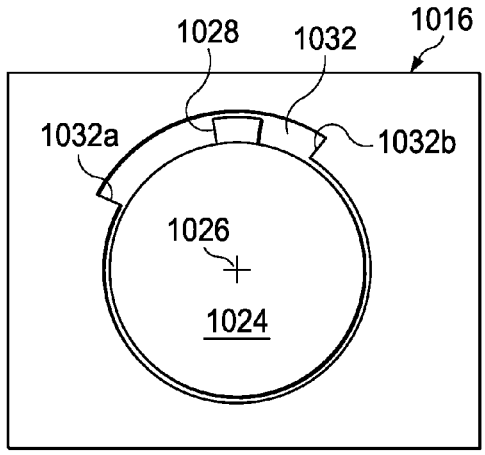

Referring to FIGS. 12A-12C are several diagrams that illustrate an exemplary release mechanism 1024 (e.g., turn-knob 1024) in accordance with an embodiment of the present invention. In FIG. 12A, the end 1016 from which the fifth magnetic field emission structure 1018 extends is shown along with a portion of the end 1020 from which the mirror image sixth field emission structure 1022 extends. The fifth magnetic field emission structure 1018 is physically secured to the release mechanism 1024. The release mechanism 1024 and the fifth magnetic field emission structure 1018 are also configured to turn about axis 1026 with respect to and within the end 1016 allowing them to rotate such that the fifth magnetic field emission structure 1018 can be attached to and separated from the sixth magnetic field emission structure 1022. Typically, the release mechanism 1024 and the fifth magnetic field emission structure 1018 would be turned by the user's hand. The release mechanism 1024 can also include at least one tab 1028 which is used to stop the movement of the fifth magnetic field emission structure 1018 relative to the sixth magnetic field emission structure 1022. In FIG. 12B, there is depicted a general concept of using the tab 1028 to limit the movement of the fifth magnetic field emission structure 1018 between two travel limiters 1030*a* and 1030*b* which protrude up from the end 1016. The two travel limiters 1030*a* and 1030*b* might be any fixed object placed at desired locations on the end 1016 where for instance they limit the turning radius of the release mechanism 1024 and the fifth magnetic field emission structure 1018. FIG. 12C depicts an alternative approach where the end 1016 has a travel channel 1032 formed therein that is configured to enable the release mechanism 1024 (with a tab 1028) and the fifth magnetic field emission structure 1018 to turn about the axis 1026 where the travel limiters 1032*a* and 1032*b* limit the turning radius. For example, when the tab 1028 is stopped by travel limiter 1032*a* (or travel limiter 1030*a*) then the end 1016 can be separated from the other end 1020, and when the tab 1028 is stopped by travel limiter 1032*b* (or travel limiter 1030*b*) then the end 1016 is secured to the other end 1020. If desired, a similar release mechanism 1024 could be used on anyone of the objects 1010*a* . . . 1010*f* (see FIGS. 10A-10B).

Figure 13A:
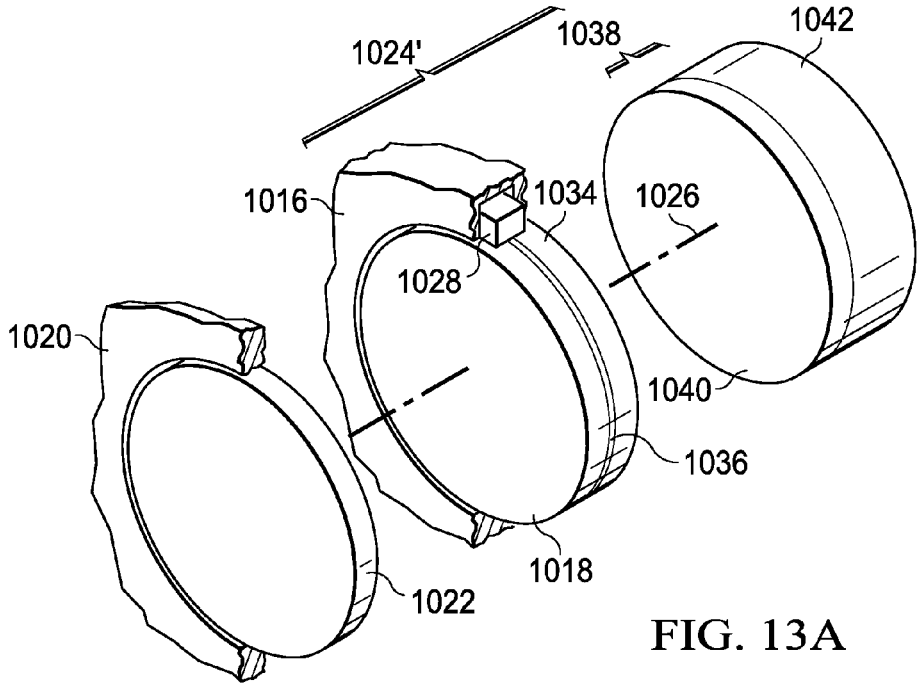
FIGS. 13A-13C illustrate several diagrams of an exemplary release mechanism that can be used to attach or separate two ends of the scuba harness in accordance with an embodiment of the present invention.
Figure 13B:
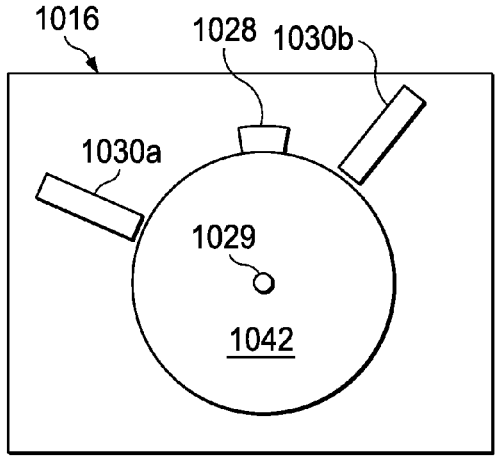
Figure 13C:
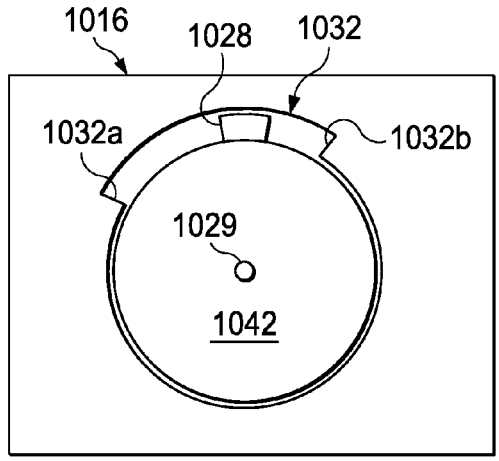

Referring to FIGS. 13A-13C are several diagrams that illustrate another exemplary release mechanism 1024' (e.g., turn-knob 1024') in accordance with an embodiment of the present invention. In FIG. 13A, the one end 1016 has the fifth magnetic field emission structure 1018 with a first code and the other end 1020 has the mirror image sixth magnetic field emission structure 1022 also based on the first code. The fifth magnetic field emission structure 1018 is physically secured to the release mechanism's magnetic field emission structure 1034 which has a second code. A separation layer 1036 made from a high permeability material may be placed between the two magnetic field emission structures 1018 and 1034 to keep their magnetic fields from interacting with one another. The two magnetic field emission structures 1018 and 1034 are configured so that they can turn about axis 1026 allowing them to be moved so as to allow attachment to and detachment from the sixth magnetic field emission structure 1022 which enables the two ends 1016 and 1020 to be connected to and separated from one another. The release mechanism 1024' can also include at least one tab 1028 which is positioned to stop the movement of the two magnetic field emission structures 1018 and 1034. In addition, the release mechanism 1024' can include a key mechanism 1038 which has a magnetic field emission structure 1040 which is coded using the second code such that it corresponds to the mirror image of the magnetic emission field structure 1034. The key mechanism 1038 also includes a gripping mechanism 1042 that would typically be turned by hand. As shown, the key mechanism 1038 can be attached to the end 1016 by substantially aligning the two magnetic field structures 1034 and 1040. The gripping mechanism 1042 can then be turned about axis 1026 so as to align or misalign the fifth and sixth magnetic field emission structures 1018 and 1022, thereby attaching or detaching the two ends 1016 and 1020. In FIG. 13B, there is depicted a general concept of using the tab 1228 so as to limit the movement of the two magnetic field emission structures 1018 and 1034 between two travel limiters 1030*a* and 1030*b*. The two magnetic field emission structures 1018 and 1034 can have a hole 1029 through their middle that enables them to turn about the axis 1026. The two travel limiters 1030*a* and 1030*b* might be any fixed object placed at desired locations that limit the turning radius of the two magnetic field emission structures 1018 and 1034. FIG. 13C depicts an alternative approach where end 1016 includes a travel channel 1032 that is configured to enable the two magnetic field emission structures 1018 and 1034 to turn about the axis 1026 using hole 1029 and has travel limiters 1032*a* and 1032*b* that limit the turning radius. One skilled in the art would recognize that the tab 1028 and at least one travel limiter 1030*a*, 1030*b*, 1032*a* and 1032*b* are provided to simplify the detachment of key mechanism 1038 from the end 1016. If desired, a similar release mechanism 1024' could be used on anyone of the objects 1010*a* . . . 1010*f* (see FIGS. 10A-10B).

In another feature of the present invention, the user of the correlated magnetic harness 1000 can remove therefrom one or more objects 1010 and attach those objects 1010 to other surfaces or objects within an environment having appropriate magnetic field emission structures. For example, the user of the scuba harness 1000 can remove the dive light 1010*b* and spear gun 1010*f* and attach them to a side of a boat or on a wall in a dive shop-garage which has the appropriate magnetic field emission structures. In another example, a user (underwater welder diver) of the correlated magnetic harness 1000 can remove a tool which has a magnetic field emission structure incorporated thereon such as a flashlight and attach the flashlight to a location for instance on an oil platform which has an appropriate magnetic field emission structure. Plus, the correlated magnetic harness 1000 can have magnetic field emission structures incorporated therein that enable them to be attached to other surfaces or objects within an environment such as the side of a boat, on the wall in a dive shop-garage, or any other location like an oil platform, telephone pole, in a bucket of a bucket truck, military vehicle etc. . . . which has the appropriate magnetic field emission structure(s). Even display racks in stores can incorporate the appropriate magnetic field emission structures to support the correlated magnetic harness 1000 and the associated objects 1010.

Although multiple embodiments of the present invention have been illustrated in the accompanying Drawings and described in the foregoing Detailed Description, it should be understood that the present invention is not limited to the disclosed embodiments, but is capable of numerous rearrangements, modifications and substitutions without departing from the invention as set forth and defined by the following claims.

The invention claimed is:

1. A harness, comprising:

a vest including a first field emission structure; and an object including a second field emission structure, where the object is attached to the vest when the first and second field emission structures are located next to one another and have a certain alignment with respect to one another, where each of the first and second field emission structures include a plurality of field emission sources having positions and polarities relating to a desired spatial force function that corresponds to a relative alignment of the first and second field emission structures within a field domain, said spatial force function being in accordance with a code, said code corresponding to a code modulo of said first plurality of field emission sources and a complementary code modulo of said second plurality of field emission sources, said code defining a peak spatial force corresponding to substantial alignment of said code modulo of said first plurality of field emission sources with said complementary code modulo of said second plurality of field emission sources, said code also defining a plurality of off peak spatial forces corresponding to a plurality of different misalignments of said code modulo of said first plurality of field emission sources and said complementary code modulo of said second plurality of field emission sources, said plurality of off peak spatial forces having a largest off peak spatial force, said largest off peak spatial force being less than half of said peak spatial force.

2. The harness of claim 1, wherein the object is released from the vest when the first and second field emission structures are turned with respect to one another.

3. The harness of claim 2, wherein the object further includes a release mechanism that includes at least one field emission structure which is used to turn the second field emission structure with respect to the first field emission structure so as to release the object from the at least one strap-vest.

4. The harness of claim 1, wherein the object further includes a release mechanism which is used to turn the second field emission structure with respect to the first field emission structure.

5. The harness of claim 1, wherein the vest has attached thereto a plurality of the first field emission structures which interact with a plurality of the second field emission structures that are attached to a plurality of objects.

6. The harness of claim 1, wherein the vest has attached thereto a third field emission structure which interacts with a fourth field emission structure that is attached to a second object, where the fourth field emission structure does not interact with the first field emission structure.

7. The harness of claim 1, wherein the vest has one end which has attached thereto another field emission structure and another end which has attached thereto yet another field emission structure, wherein the one end is attached to the other end when the another field emission structure and the yet another field emission structure are located next to one another and have a certain alignment with respect to one another, wherein the one end is released from the another end when the another field emission structure and the yet another field emission structure are turned with respect to one another.

8. The harness of claim 7, wherein the one end further includes a release mechanism that includes at least one field emission structure which is used to turn the another field emission structure with respect to the yet another field emission structure so as to release the one end from the another end.

9. The harness of claim 1, wherein said positions and said polarities of each of said field emission sources are determined in accordance with at least one correlation function.

10. The harness of claim 9, wherein said at least one correlation function is in accordance with at least one code.

11. The harness of claim 10, wherein said at least one code is at least one of a pseudorandom code, a deterministic code, or a designed code.

12. The harness of claim 10, wherein said at least one code is one of a one dimensional code, a two dimensional code, a three dimensional code, or a four dimensional code.

13. The harness of claim 1, wherein each of said field emission sources has a corresponding field emission amplitude and vector direction determined in accordance with the desired spatial force function, wherein a separation distance between the first and second field emission structures and the relative alignment of the first and second field emission structures creates a spatial force in accordance the desired spatial force function.

14. The harness of claim 13, wherein said spatial force comprises at least one of an attractive spatial force or a repellant spatial force.

15. The harness of claim 13, wherein said spatial force corresponds to a peak spatial force of said desired spatial force function when said first and second field emission structures are substantially aligned such that each field emission source of said first field emission structure substantially aligns with a corresponding field emission source of said second field emission structure.

16. The harness of claim 1, wherein said field domain corresponds to first field emissions from said first field emission sources of said first field emission structure interacting with second field emissions from said second field emission sources of said second field emission structure.

17. The harness of claim 1, wherein said polarities of the field emission sources comprise at least one of North-South polarities or positive-negative polarities.

18. The harness of claim 1, wherein at least one of said field emission sources includes a magnetic field emission source or an electric field emission source.

19. The harness of claim 1, wherein at least one of said field emission sources includes a permanent magnet, an electromagnet, an electret, a magnetized ferromagnetic material, a portion of a magnetized ferromagnetic material, a soft magnetic material, or a superconductive magnetic material.

20. A method for enabling an object to be attached to and removed from a vest, said method comprising the steps of:

attaching a first field emission structure to the vest;

attaching a second field emission structure to the object; and aligning the first and second field emission structures so the object attaches to the vest when the first and second field emission structures are located next to one another, where each of the first and second field emission structures include a plurality of field emission sources having positions and polarities relating to a desired spatial force function that corresponds to a relative alignment of the first and second field emission structures within a field domain, said spatial force function being in accordance with a code, said code corresponding to a code modulo of said first plurality of field emission sources and a complementary code modulo of said second plurality of field emission sources, said code defining a peak spatial force corresponding to substantial alignment of said code modulo of said first plurality of field emission sources with said complementary code modulo of said second plurality of field emission sources, said code also defining a plurality of off peak spatial forces corresponding to a plurality of different misalignments of said code modulo of said first plurality of field emission sources and said complementary code modulo of said second plurality of field emission sources, said plurality of off peak spatial forces having a largest off peak spatial force, said largest off peak spatial force being less than half of said peak spatial force.

21. The method of claim 20, further comprising a step of turning the first emission structure with respect to the second field emission structure to remove the object from the vest.

22. The method of claim 20, wherein the vest is a selected one of a construction work vest, a soldier vest, an astronaut vest, and a scuba vest.

23. The method of claim 20, where the object is a selected one of a tool, a weight pouch, a utility pocket, a scuba weight, a lanyard, a flash light, a camera, a knife, a spear gun, a navigation board, a depth gauge, or military equipment.

24. The method of claim 20, wherein the harness has another field emission structure which enables the harness to be attached to or removed from a surface or object within an environment having an appropriate field emission structure.

25. The method of claim 20, wherein the object is able to be attached to or removed from a surface or object within an environment having an appropriate field emission structure.

* * * * *